United States Patent [19]

Quinto

[11] 4,173,666

[45] Nov. 6, 1979

[54] FLAME RESISTANT CELLULOSE FIBER INSULATION AND PROCESS OF PREPARING IT

[76] Inventor: Mario J. Quinto, The Seaco Corp., 581 Hope St., Stamford, Conn. 06907

[21] Appl. No.: 941,652

[22] Filed: Sep. 11, 1978

[51] Int. Cl.[2] ..... D04H 1/58

[52] U.S. Cl. ..... 427/427; 428/288; 428/289; 428/920; 428/921

[58] Field of Search ..... 428/288, 289, 920, 921; 427/427

[56] References Cited

U.S. PATENT DOCUMENTS

| | | | |
|---|---|---|---|
| 3,027,326 | 3/1962 | Moffett | 252/62 |
| 4,012,507 | 3/1977 | Knoepller | 427/212 |

*Primary Examiner*—Marion E. McCamish
*Attorney, Agent, or Firm*—Robert Ames Norton

[57] ABSTRACT

This invention produces flame resistant cellulose fiber insulation, which will be referred to as CFI. The best flameproofing agents which have been used in the past are mixtures of boric acid and borax as the major portion of the mix and have been applied both as dry powders and sprayed from water dispersions. Boric acid is quite expensive as it is prepared from borax by the addition of acid and purification of the boric acid. In the present invention lower cost materials and process are obtained by applying a mixture of boric acid and borax which has been prepared by adding acid, such as sulfuric acid, a mixture of sulfuric and phosphoric acid, and the like, to borax to transform a portion of the borax into boric acid. The reaction products, sodium sulfate, or a mixture of sodium sulfate and sodium phosphate in the case both acids are used, remain in the material applied to CFI. While they are not by themselves highly effective flameproofing agents, particularly sodium sulfate is not, they do add somewhat to flame resistance. In other words, the elimination of the step of separating and/or purifying boric acid is eliminated without, however, eliminating its function. The product produced is as good a flame retarder when applied to CFI; in fact it is slightly better. Additionally there are great savings in cost.

3 Claims, No Drawings

FLAME RESISTANT CELLULOSE FIBER INSULATION AND PROCESS OF PREPARING IT

BACKGROUND OF THE INVENTION

Cellulose fiber insulation, hereinafter referred to as CFI, is increasingly used as insulating material for buildings. Its cost is much less than the mineral insulating materials, such as slag wool, glass fibers, and the like. Also, the great demand for insulation resulting from increased energy costs has created a serious shortage of mineral insulating materials. CFI is usually produced from waste paper or other waste cellulosic materials which are comminuted or otherwise reduced to small sizes. Since they are produced by purely mechanical means from material such as waste paper and other waste cellulosic materials that have little or no value, their cost is considerably less than slag wool, fiberglass, and the like. CFI is an excellent insulator but it is also flammable and so cannot be used without application of fire retardant materials, which are mandatory in practically all building codes; as a matter of fact, when properly treated with fire retardant CFI is a markedly better insulator than mineral insulators, such as glass wool, slag wool, and the like.

Numerous fire retardants have been used, the best at the present time being a mixture of boric acid and borax. Application to the CFI after comminution or during comminution has been effected either by applying dry chemicals or spraying on dispersions, such as solutions in water, during the manufacture of the CFI or after it has been manufactured. CFI treated with a boric acid-borax mixture has adequate fire resistance to meet building codes although, of course, not quite as fire resistant as the inorganic materials, such as glass fibers, slag wool, and the like. However, because of the lower cost of fire resistant CFI and the shortage of the mineral insulation, such as glass fibers, sometimes referred to as glass wool, there is an increasing demand for the cheaper CFI when rendered sufficiently fire resistant to meet building codes.

In the past CFI has been rendered fire resistant by applying mixtures of boric acid and borax, either in dry form, usually during the comminution of the CFI, or by spraying a liquid dispersion, such as a solution in water, which can be applied either during comminution of the CFI or even after it has been comminuted. The principal cost of the treatment is the relatively high cost of boric acid, which is produced from borax by treatment with acid and separating and/or purifying the boric acid produced. It is with a cheaper product containing boric acid and borax, without any loss of fire retardancy, and in fact a slight improvement, that the present invention deals.

SUMMARY OF THE INVENTION

The present invention reduces markedly the cost by eliminating the steps of separation, evaporation, and/or purification of the boric acid without eliminating their function in the final fire retardant composition. Another advantage of the present invention is that there is a significant saving in energy which had to be used when the boric acid was recovered or separated. Also, when boric acid and borax were used in the past usually they were purchased as solids and therefore cold. In the preferred form of the present invention, as will be pointed out below, the addition of strong sulfuric acid to water heats up the solution and therefore reduces the amount of energy needed to dissolve the boric acid and borax powders used before where, as often, it is desired to make a warm or hot solution in water in order to get better concentration and also in many cases better penetration of the CFI. In fact the product obtained is not only as good but slightly better in its fire retardancy.

In the present invention borax is treated with an acid, such as sulfuric acid, which is the cheapest acid, or preferably a mixture of sulfuric acid and phosphoric acid.

Other acids may, of course, be used, and the present invention is, therefore, not strictly limited to the use of sulfuric acid or a mixture of sulfuric acid and phosphoric acid. However, under present economic conditions, there is no advantage in using any other acids as they are either more expensive than sulfuric acid and especially than phosphoric acid or produce salts on reacting with the borax which are not as desirable in the finished CFI as sodium sulfate and/or sodium sulfate and sodium phosphate. Therefore, these acids are preferred although the present invention does not exclude the use of other acids.

The present invention does not distinguish from the prior art in the amounts of boric acid and borax which are finally introduced into the CFI, and amounts of these materials which have been used in the past, such as, for example, 10% to 20%, preferably 7% to 15%, dry weight of solids, to produce Class I fire resistance are not changed. It should be understood that these figures apply to the mixture of boric acid and borax and the total weight of solids may be somewhat higher because of the presence of sodium sulfate with or without sodium phosphate which are present and are not removed in the present invention. Also, the present invention does not exclude the addition of some other materials, such as aluminum sulfate, aluminum hydroxide, ammonium sulfate, urea, urea formaldehyde resins, and the like, which have sometimes been used in the past. However, the primary fire retardant materials are still the boric acid-borax mixture. In referring to phosphoric acid and, after reaction with the sodium in the borax, the sodium salts, it should be understood that the present invention is not limited to any particular phosphoric acid; thus orthophosphoric acid, metaphosphoric acid, pyrophosphoric acid, and the like may be used. In general, the cheapest acid will be employed as just as good results are obtained. Sometimes there are byproduct waste phosphoric acids which in certain places in the country are cheaper than the single phosphoric acids themselves, and as they are being used only to transform some of the borax into boric acid and, of course, to produce the corresponding sodium phosphates, they may be used. In most cases phosphoric acid is considerably more expensive than sulfuric acid. Although the resulting sodium phosphates are slightly more effective flame resistant materials than sodium sulfate, when mixtures of the two acids are used, usually more sulfuric acid is preferred, for example, a 50% excess over the amount of phosphoric acid.

From a process standpoint, exact amounts are not critical, and this makes the process very simple and permits an additional saving. While the proportions are not critical, as has been stated above, once a mixture has been determined as a suitable match in a CFI plant, it will naturally be retained within a small figure of a few percent in order to assure the production of consistent products. The solubility of borax and boric acid in water increases with temperature, and so when they are dissolved in water, moderate warming, for example 40° to 50° C., is desirable. When strong sulfuric acid is added to water, considerable heat is evolved, and this eliminates or reduces the additional heat required to produce the mixture of boric acid and borax. This reduces or eliminates any additional heat, which results in a cost saving and an energy saving.

Although, as has been pointed out before, exact amounts of the materials are not critical, it is nevertheless desirable to maintain a useful quality range, and so, if desired, indicators, such as fluorescent pigments, may be used so that the approximate concentration on the CFI can be determined by estimating brightness of fluorescence when illuminated with a given source of ultraviolet light. This is not essential but is a useful and practical quality control and can also be used as identification of treated CFI from a particular source. Because of the very large amount of water crystallization in commercial borax, about 10 moles, the amount of acid, either sulfuric acid or a mixture of sulfuric and phosphoric acids, by weight is much less than the borax. Also, the mild alkalinity of the borax, approximately a pH of 8.5, is reduced in the final solution to approximate neutrality. Of course, if desired, in producing the mixture of boric acid and borax and the other salts in the process a pH indicator may be used in the final water solution, where spraying is used, which is the preferred method of applying the fire resistant material. Exact neutrality, that is exactly pH 7, is not critical but the water solution should approximate neutrality so that after spraying on CFI any moisture which may accidentally or unavoidably enter the CFI in an insulated building will not produce either strong strong acid or strong alkali, so that portions of the building, such as ducts, electrical conduits, and other metal structures, are not seriously attacked.

The cellulosic material which is comminuted or broken apart to produce the CFI is not critical. The cheapest materials are waste products, such as old newspapers, old pieces of cardboard, and the like. So long as the comminution of the CFI produces a product with the requisite amount of air spaces to effect adequate insulation, the particular material is not the critical factor of the present invention, and the usual raw materials currently made into CFI may be employed without change. Similarly, the final CFI insulation, whether in batts or loose, is not essentially different from that in current use except, of course, for the presence of the sodium salts which result from the treatment of the borax. Thus in the case of batts, a vapor barrier can be used whenever this is desirable. It is an advantage of the present invention that the standard forms of insulation are not changed but cost is reduced and fire retardancy slightly increased.

It should be noted that when the preferred mixtures, which are the reaction products of both sulfuric and phosphoric acids, are used the sodium phosphates which result are excellent detergents which facilitate the dispersion of the solution and the penetration. This is sometimes of importance where some of the materials used in making the CFI are coated papers.

It is sometimes desirable in the case of the present invention to produce the solutions of the boric acid and borax and to sell the solutions as such to plants where they are sprayed or otherwise caused to adhere to the cellulose fibers. This sometimes presents a problem because when the solution is made it is warm and the solubility of the various materials is greater. If the solution is sold as such or is stored in a plant because it is not being sprayed at the moment, it cools down, and this can result in precipitation of some of the materials. In such cases protective agents which inhibit crystallization may be added. This is not the major feature of the present invention but is mentioned as in some cases it may be desirable.

The present invention deals with practical commercial products. In other words, the borax which is reacted with the acid or acids is not necessarily pure borax. When borax is mined from certain deposits there are some other cations, such as, for example, calcium. If the amounts of these additional cations are not too great, the cruder material can be used and can further reduce the cost. It should be noted that these additional cations, if they are not in too large proportions, produce materials which are not combustible, for example calcium sulfate and phosphate. These materials are sometimes insoluble but if they are not present in too great amounts and are well distributed, as they are in the present invention, they can actually add slightly to the fire retardancy. However, it should be understood that the borax and the boric acid constitute the major constituents of the fire retardant mix that is on the CFI.

DESCRIPTION OF THE PREFERRED EMBODIMENTS

In the examples which will follow, the parts are by weight unless otherwise stated.

Example 1

An amount of water which, after reaction of 100 lbs. of borax and 10.7 lbs. of a mixture of sulfuric acid and orthophosphoric acid in the proportion of approximately 3 moles of sulfuric acid to 2 moles of orthophosphoric acid in an amount of water approximately equal in weight to the reaction products, i.e., boric acid, sodium sulfate, and sodium orthophosphate, taking into consideration the 10 moles water of crystallization in the borax set free from the portion of borax entering into the reaction is used. To the water the sulfuric acid is first added and then the phosphoric acid and, finally, the 100 lbs. of borax. The sulfuric acid reacts with the water to evolve heat to bring the temperature of the solution to approximately 40° C. The solution is sprayed onto an amount of CFI to coat uniformly the comminuted particles, i.e., fibers and other small particles of cellulose, and is allowed to dry. The solids, i.e., unreacted borax, boric acid, sodium sulfate, and sodium orthophosphate, are uniformly distributed over the surfaces of the comminuted cellulose in the CFI.

Although spraying the solution onto the cellulose fibers is the preferred way of producing the fire resistant CFI, it is possible to spray the cellulose material either before it is being comminuted or during comminution, for example, as the cellulose is conveyed past the liquid spray. The spraying may also be done into a comminuter as the cellulose is being comminuted. Spraying may also be on the cellulose fibers as they are being mixed after comminution.

The fire resistance of the treated CFI is slightly greater than CFI treated with the same amount of boric acid and borax because of the additional presence of sodium sulfate and sodium orthophosphate. The major portion of the additional fire resistance is contributed by the sodium phosphate. It should be noted that when borax is reacted with acids the reaction product is not literally 100% orthoboric acid. There are small portions of other boric acids, such as metaboric acid. All of these boric acids take part in the rendering of the CFI more fire resistant.

Example 2

Basing on 1,000 lbs. of an approximately 20% solution, which would mean 798 lbs. of water, 179 lbs. of borax, and 23 lbs. of sulfuric acid are reacted as described in Example 1. The heating of the sulfuric acid reacting with the water is approximately to about 40° to 50° C., at which temperature the borax and boric acid are sufficiently soluble so that a solution results. This solution is sprayed on CFI as described in connection with Example 1. The treated CFI meets present standards but has a fire resistance slightly less than the product of Example 1 because of the greater additional fire resistance of the sodium phosphate in the first example.

I claim:

1. A process of producing flame resistant cellulose fiber insulation which comprises producing an aqueous solution of the reaction product of borax and at least one mineral acid and spraying cellulose fiber insulation with said solution without separation of the reaction products to produce a sprayed product, whereby the solution penetrates the cellulose fibers and coats them uniformly, and product which on drying has about 7% to about 20% of solids of the reaction products.

2. A process according to claim 1 in which the acid is sulfuric acid.

3. A process according to claim 1 in which the acid is a mixture of sulfuric and phosphoric acids, with the sulfuric acid present in larger quantities than the phosphoric acid.

* * * * *